US005272978A

United States Patent [19]

Wehle et al.

[11] Patent Number: 5,272,978

[45] Date of Patent: Dec. 28, 1993

[54] APPARATUS FOR STRETCHING A CYLINDER BLANKET ON A SHEET TRANSFER CYLINDER OF A SHEET-FED ROTARY PRINTING PRESS

[75] Inventors: Josef Wehle, Schwetzingen; Nikolaus Spiegel, Walldorf; Hans-Georg Jahn, Wiesloch, all of Fed. Rep. of Germany

[73] Assignee: Heidelberger Druckmaschinen AG, Heidelberg, Fed. Rep. of Germany

[21] Appl. No.: 864,870

[22] Filed: Apr. 6, 1992

[30] Foreign Application Priority Data

Mar. 14, 1992 [DE] Fed. Rep. of Germany ..... 4208209

[51] Int. Cl.[5] ..... B41N 10/06; B41F 30/04; B41F 21/10

[52] U.S. Cl. ..... 101/415.1; 101/409; 101/422

[58] Field of Search ..... 101/378, 382.1, 383, 101/415.1, 422, 410, 409

[56] References Cited

U.S. PATENT DOCUMENTS

| | | | |
|---|---|---|---|
| 912,724 | 2/1909 | Pancoast | 101/415.1 |
| 1,604,082 | 10/1926 | Smothers | 101/415.1 |
| 1,858,305 | 5/1932 | Meisel et al. | 101/415.1 |
| 3,237,558 | 3/1966 | Fagg | 101/415.1 |
| 4,227,459 | 10/1980 | Jeschke | 101/415.1 |
| 5,003,878 | 4/1991 | Dorow et al. | 101/415.1 |
| 5,131,326 | 7/1992 | Wrzesinski | 101/382.1 |

FOREIGN PATENT DOCUMENTS 7522036 5/1977 Fed. Rep. of Germany .

*Primary Examiner*—Edgar S. Burr
*Assistant Examiner*—Stephen R. Funk
*Attorney, Agent, or Firm*—Nils H. Ljungman & Associates

[57] ABSTRACT

An apparatus for stretching a cylinder blanket on a sheet transfer cylinder of a sheet-fed printing press includes a tiltable member mounted on the cylinder. A first end of the blanket is first attached to the cylinder in a cylinder groove, the blanket is wrapped around the cylinder, and the second end of the blanket is attached to the tiltable member, while the tiltable member is in an open position. The tiltable member is then closed to stretch the blanket about the cylinder, and locked into the closed position to maintain the blanket about the cylinder.

19 Claims, 3 Drawing Sheets

APPARATUS FOR STRETCHING A CYLINDER BLANKET ON A SHEET TRANSFER CYLINDER OF A SHEET-FED ROTARY PRINTING PRESS

BACKGROUND OF THE INVENTION

A. Field of the Invention:

This invention relates to an apparatus for stretching a cylinder blanket on a sheet transfer cylinder of a sheet-fed rotary printing press. A first end of the blanket is maintained in a cylinder groove, and the other end of the blanket is fastened to a tiltable segment. The blanket is attached to the tiltable segment when the tiltable segment is in an open position, and the blanket is then stretched by closing the tiltable segment.

B. Background Information:

One example of a tiltable cylinder segment that could be used for stretching a cylinder blanket can be found in U.S. Pat. No. 1,858,305. However, the disclosed device is a printing plate stretching device on a plate cylinder, and it is not possible to stretch a blanket on a transfer cylinder in the same manner that a blanket can be stretched on a plate cylinder.

Another stretching apparatus for a blanket can be found in German Patent No. 75 22 036. However, the German patent does not provide a simple and easy manner in which to stretch the blanket.

OBJECT OF THE INVENTION

The object of this invention is therefore to create a stretching apparatus for a blanket on a transfer cylinder for a sheet-fed printing press, on which cylinder it is easily possible to stretch and change the blanket, even inside the press, without having to remove the entire cylinder from the press.

SUMMARY OF THE INVENTION

This object is achieved by the present invention with a blanket that is stretched around the transfer cylinder by a tilting mechanism. On the outer edge of the end-of-printing end of the blanket, there are preferably several bolts or bottom means located in proximity to one another across the width of the blanket. These bolts are for being suspended in recesses of a leaf spring that is fastened into a groove of the cylinder and extends over the length of the cylinder. In the peripheral region on the other end of the blanket, or the start-of-printing end, the blanket preferably has a spring rod which extends across the width of the blanket. This spring rod is for being suspended by several bolts in proximity to one another, installed across the length of the tilting segment. The tilting segment is openable to allow for fastening of the blanket to the tilting segment, and by closing the tilting segment with the blanket attached thereto, the blanket is essentially stretched around the cylinder. The tilting segment can be locked into the closed position by fastening with locking means, such as locking screws.

By means of the solution according to the present invention, it becomes possible to easily insert or replace a blanket on the cylinder, which insertion or replacement of a blanket is possible even in the printing press, without having to remove the entire cylinder from the press. The solution of the present invention also essentially simultaneously guarantees that when the blanket is stretched, it will essentially always have precisely the required tension. Also, because there may be variance in the blankets due to manufacturing tolerances, the solution according to the present invention essentially provides compensation for any manufacturing tolerances which may be present.

Several additional advantageous configurations of the invention preferably include providing the tilting segment with adjusting means, such as adjusting screws or set screws, so that the position of the tilting segment can be adjusted on the cylinder, securing the ends of the blanket by leaf springs, and providing a liner sheet, or mat, under the blanket, to cover the surface of the cylinder.

In place of the blanket, which is typically used to prevent smearing and thus damage to the printed image on freshly printed sheets, a metal film which has an ink repellant surface can also be used. In a modification of the solution disclosed above, one advantageous configuration of the invention provides the ability for using the present invention to secure the metal film to the cylinder. In this embodiment, the metal film can be bent back at the start-of-printing end, suspended on the tilting segment and secured by leaf springs. Just as for stretching a blanket, the tilting segment can be closed and fastened in place by the locking means, such as the locking screws. In this manner, a precise tension can also be applied to the metal film.

BRIEF DESCRIPTION OF THE DRAWINGS

The invention is schematically illustrated in the accompanying drawings, in which.

DESCRIPTION OF THE PREFERRED EMBODIMENTS

Figure 1:
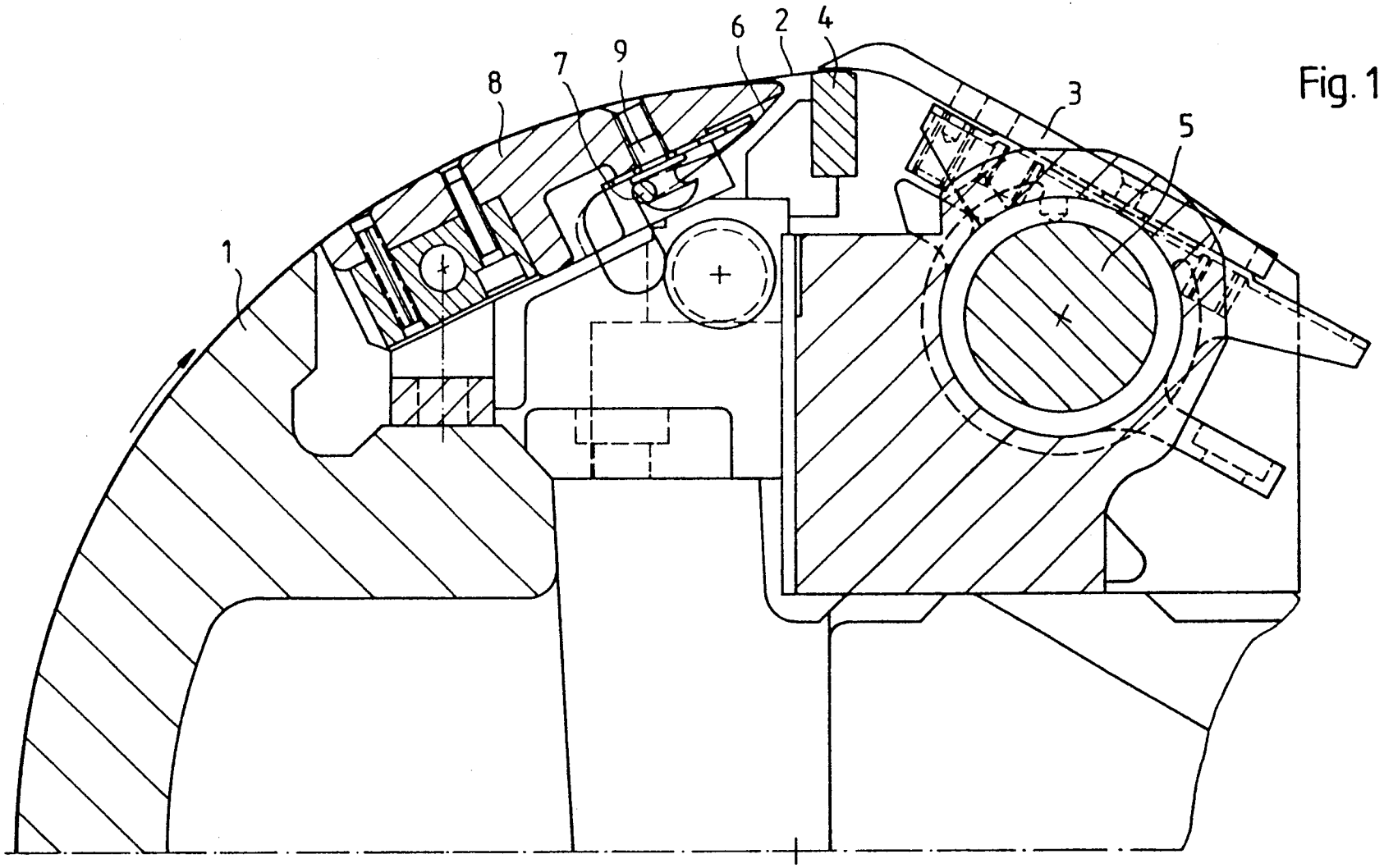
FIG. 1 shows a partial cross section through a transfer cylinder with a blanket stretched therearound.

On the transfer cylinder 1, the sheets 2, to be transported, can be held by means of a gripper system 3 and a gripper bar 4, and from the transfer cylinder, are transferred to the next transfer cylinder or printing cylinder. The gripper system 3 is preferably fastened about a gripper shaft 5, and can be controlled by cams (not shown). Since such transfer cylinders are typically used to transport freshly printed sheets, there is a danger that the fresh printing will smear on the convex surface of the transfer cylinder, and thus damage the printed image. To prevent smearing, cylinder blankets are often used. Such blankets can be made of textile material, and are typically designed so that they do not absorb any ink, thereby preventing damage to the printed image. The blankets preferably cover the entire convex surface of the transfer cylinder to which cylinder the blankets are preferably fastened under tension.

In the embodiment illustrated in FIG. 1, a blanket 6 is stretched around the convex surface of the transfer cylinder 1. A first end of the blanket, which typically is disposed adjacent a starting edge of a printed sheet when a printed sheet is disposed about the cylinder, is sometimes called the start-of-printing end, while the other end of the blanket, disposed at the opposite edge of a printed sheet when a printed sheet is disposed about the cylinder is sometimes called the end-of-printing end. In the peripheral region at the start-of-printing end, there is preferably a resilient means, such as a spring rod 7, which preferably extends along the entire width of the blanket. The spring rod 7 can be suspended from the tilting segment 8 by means of several bolts 9 which are installed across the length of a tilting segment 8. For accommodating the spring rod 7, the bolts 9 can have recesses 9*a* which preferably have a configuration to match the configuration of the rod 7, for example a concave surface to match the convex surface of the rod. In the peripheral edge of the blanket, there can preferably be openings (not shown) which fit over the bolts 9 so that the bolts can essentially be disposed through the end of the blanket.

Figure 2:
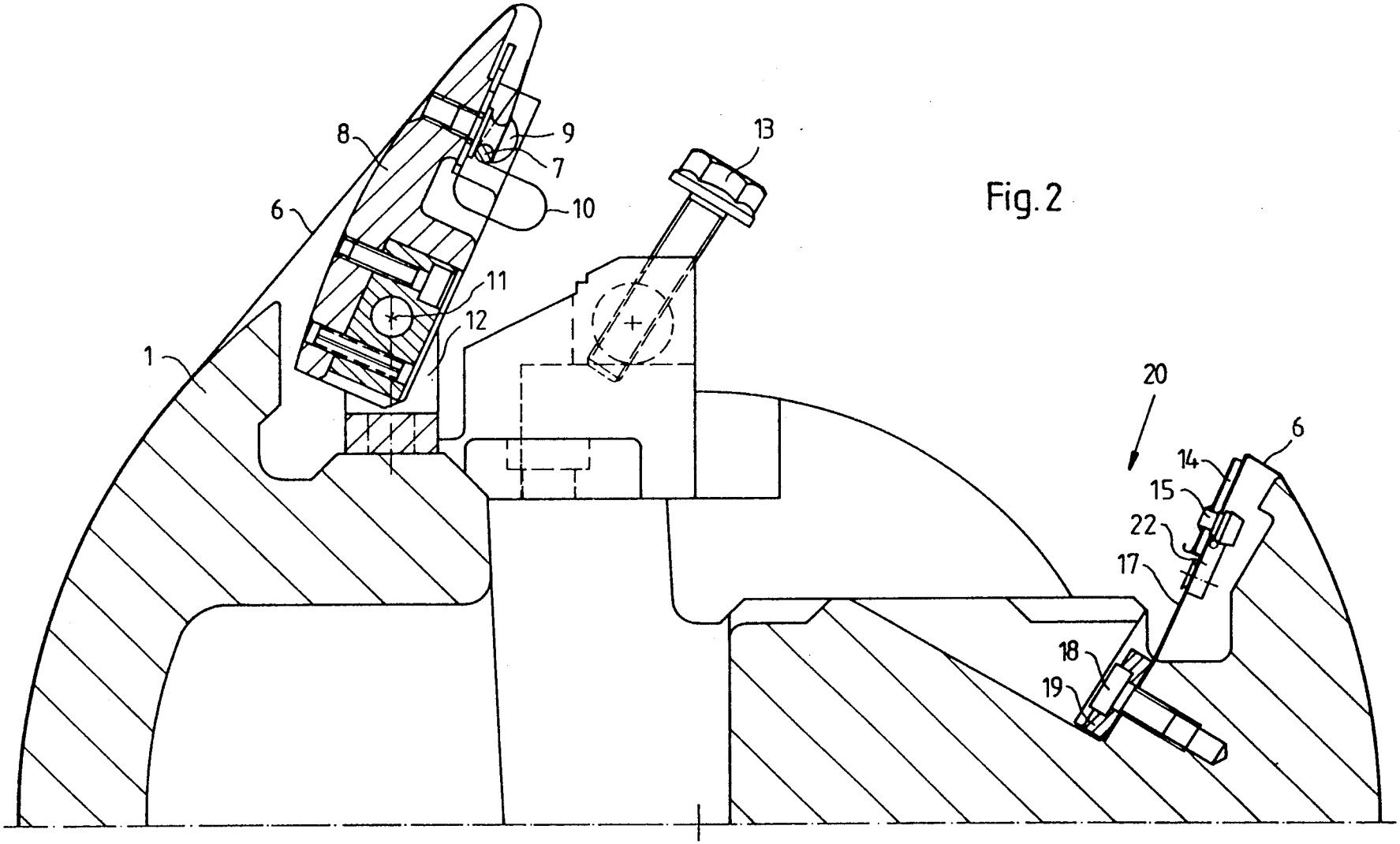
FIG. 2 shows a partial cross section through a transfer cylinder with the tilting segment in an open position.

In FIG. 2, the tilting segment 8 is shown in the opened position, in which position the blanket 6 is essentially not stretched. To prevent the spring rod 7 from unhooking from the bolts 9, there can preferably be retaining springs 10 which are fastened by means of the bolts 9. The tilting segment 8 can preferably be supported, on both sides of the cylinder, on a pivot 11, which pivot 11 can be fastened by means of bearings 12 to the transfer cylinder 1.

When the tilting segment 8 is tilted to its base position to stretch the blanket, the segment 8 can be fastened on both sides by a locking device, such as locking screws 13.

A bar 14 can preferably be fastened in the vicinity of the outer edge of the end-of-printing end of the blanket 6. Bolts, or pins, 15 can be located next to one another along this bar, and are for being suspended in recesses 16 of a leaf spring 17. The leaf spring 17 preferably extends over the entire length of the cylinder and can be fastened by means of screws 18 and a bar 19 into the cylinder groove 20 of the transfer cylinder 1.

Figure 4:
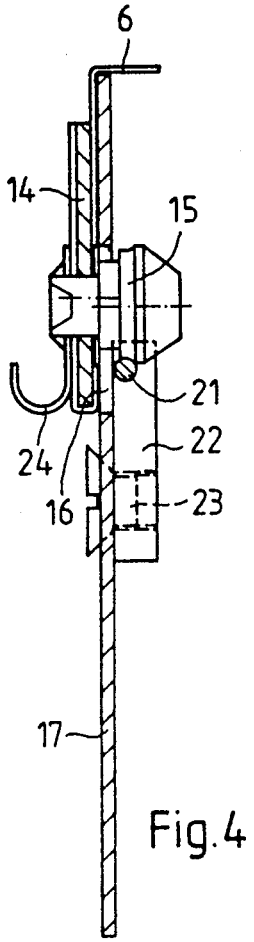
FIG. 4 shows a partial cross section through the leaf spring of FIG. 3, with suspended blanket attached thereto.
Figure 3:
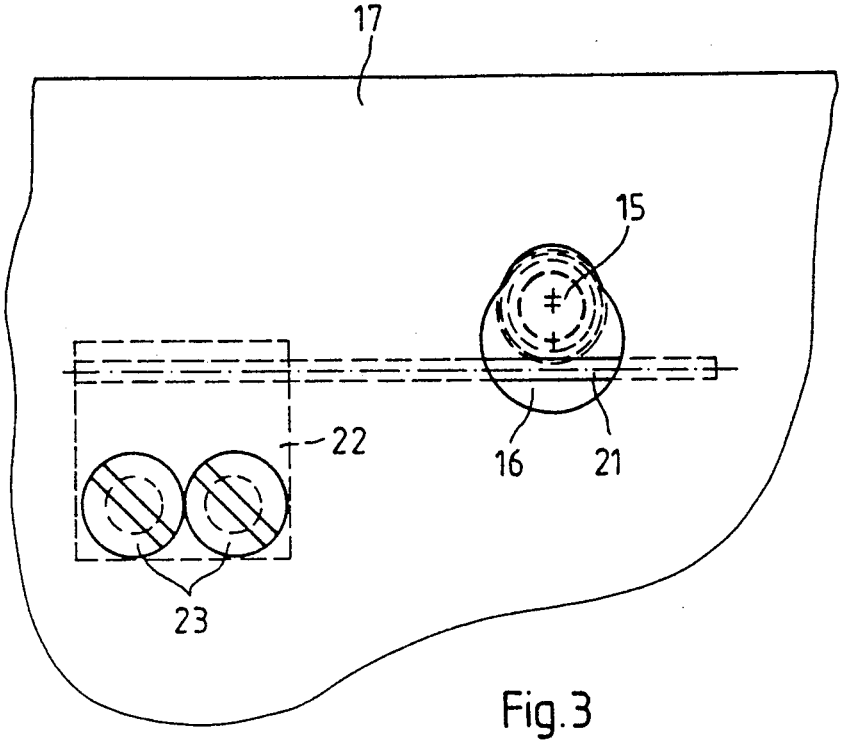
FIG. 3 shows a detail of the leaf spring at the end-of-printing end of the sheet.

In FIG. 3, the leaf spring 17 is shown with the recesses 16 into which the bolts 15 can be hooked. The bolts 15, along with the recesses 16 are preferably distributed uniformly at intervals over the length of the cylinder to provide fastening of the blanket 6 substantially evenly along the length of the cylinder. The recesses 16 can preferably have a first dimension larger than a dimension of the bolts 15 so that the bolts 15 can easily be passed through the recesses. In addition, the recesses can also have a portion 16*a* which has a dimension smaller than a dimension of the bolts 15 to maintain the bolts within the recesses once the bolts have been inserted therein. To prevent the bolts 15 from slipping out of the recesses 16, when the blanket 6 is stretched, there can be a resilient member, such as a spring rod 21, for forcing the bolt 15 into the smaller dimension portion 16*a* of the recess 16. Such a spring rod 21 can preferably be fastened in a mounting 22, which mounting 22 can, in turn, be screwed to the leaf spring 17 by means of screws 23. In this regard, FIG. 4 shows a side view, whereby a grasping device, such as a hook 24 can be fastened to the bolts 15. Such a grasping device preferably provides means by which the bolts 15 can be easily unhooked from the recesses 16 by allowing the bolts 15 to be moved against the force of the spring rod and therefore out of engagement with the small dimension portion 16*a* of the recess 16.

In view of the above description, a method for stretching the cylinder blanket onto the transfer cylinder could possibly involve the following steps:

1) fastening the end-of-printing end of the blanket 6 into the cylinder groove 20 by pushing the bolts 15 into corresponding recesses of the leaf spring 17, so that the retaining rods 21 hold the bolts 15 in the recesses;
2) wrapping the cylinder blanket about the cylinder;
3) opening the tilting member 8;
4) engaging the start-of-printing end of the blanket 6 onto the tilting member 8 by pushing the blanket over the bolts 9 so that the bolts 9 are disposed through openings (not shown) in the blanket and so that the spring rod 7 engages the bolts 9 in the recess 9*a;*
5) stretching the blanket by pivoting the tilting member 8 into its closed position; and
6) locking the tilting member 8 in the closed position by means of the locking screws 13.

Figure 5:
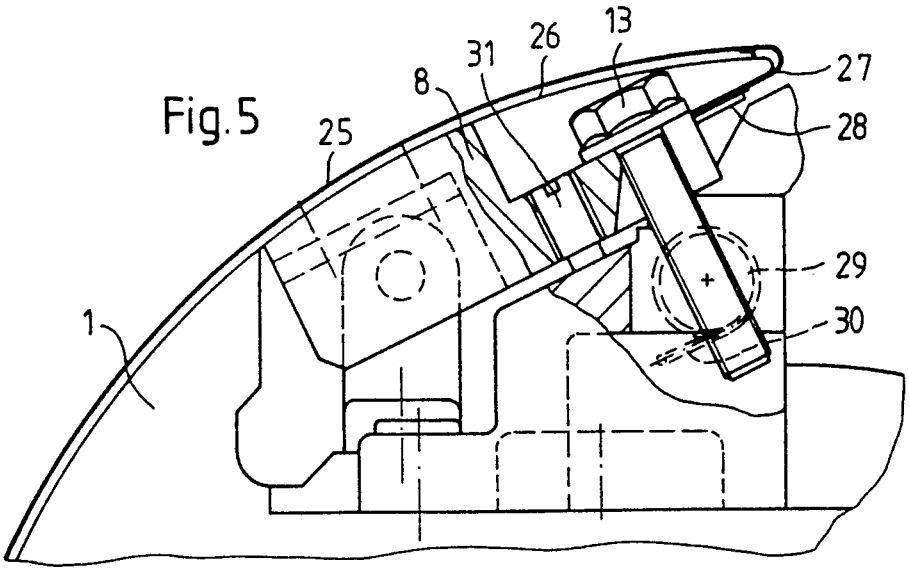
FIG. 5 shows a suspended metal film disposed over a liner sheet.

In a modification of the invention, a metal film 25, instead of a blanket, can be stretched over the convex surface of the transfer cylinder 1 as shown in FIG. 5. The metal film 25 should preferably have an ink-repellant outer surface to prevent damage to the printed image. To adjust the metal film 25 to the diameter of the cylinder, the metal film 25 can be underlaid with a liner sheet, or mat 26, of a required thickness to compensate for any diameter difference. Such a liner sheet could also be used with a blanket, if desired or if necessitated by a diameter difference. By means of a bent portion 27, the metal film can be suspended at the start-of-printing end on the tilting segment 8, and prevented from sliding out by means of a leaf spring 28. The fastening on the end-of-printing end is essentially designed like that for the blanket, as discussed above.

In FIG. 5, the tilting segment 8 can be pivoted inward and fastened by means of the locking screws 13. The locking screws 13 can then be screwed into a rotating abutment 29, which is preferably pivotable so that the screws 13 can be pivoted into a rest position, as shown in FIG. 2, by means of a resilient member, such as a torsion spring 30.

In addition, the tilting member 8 can also have set screws 31 for adjusting the tilting segment. Such an adjustment can be used to compensate for any variances in stretch between the blankets used, or to compensate for wear of the blankets which would, over time, typically increase the length of the blankets.

In summary, one aspect of the invention resides broadly in an apparatus for stretching a blanket on transfer cylinders of sheet-fed printing presses, in which the blanket is held on one end in a cylinder groove, and the other end is fastened to a tilting segment, whereby the blanket is stretched by closing the tilting segment, characterized by the fact that the blanket 6 on the end-of-printing end has several bolts 15 located next to one another across the width on the outer edge, which bolts are suspended in recesses 16 on a leaf spring 17 which extends over the length of the cylinder, whereby the leaf spring 17 is fastened in the cylinder groove 20, that the blanket 6 on the start-of-printing end has a spring rod 7, which extends over the width of the blanket in the peripheral region and is suspended in several bolts 9 located next to one another across the width on the tilting segment 8, and that the tilting segment 8 is fastened by locking screws 13 when closed.

Another aspect of the invention resides broadly in an apparatus characterized by the fact that the tilting segment 8 can be adjusted by means of set screws 31.

A further aspect of the invention resides broadly in an apparatus characterized by the fact that the ends of the blanket 6 are secured by springs 7, 21.

Still another aspect of the invention resides broadly in an apparatus characterized by the fact that a liner sheet 26 which covers the convex surface of the cylinder is stretched under the blanket 6.

A yet another feature of the invention resides broadly in an apparatus for stretching a metal film on transfer cylinders of sheet fed printing presses, characterized by the fact that the metal film 25 is bent back 27 on the start-of-printing end, suspended on the tilting segment 8 and secured by leaf springs 28.

Some examples of printing press cylinders onto which blankets are stretched, and the means for stretching the blankets onto the cylinder are disclosed in the following U.S. Pat. No. 4,854,237 to Theilacker, entitled "Printing Machine Cylinder Underlay Holding Arrangement"; U.S. Pat. No. 4,648,318 to Fischer, entitled "Rubber Blanket Attachment Arrangement for an Offset Rotary Printing Machine"; U.S. Pat. No. 4,584,942 to Sauer, entitled "Device for Fastening One Extremity of a Soft and Folding-Proof Blanket on a Cylinder of a Rotary Printing Machine"; U.S. Pat. No. 4,403,549 to Matuschke, entitled "Printing Plate Attachment Arrangement"; U.S. Pat. No. 4,263,849 to Spac and Kunkel, entitled "Stretching and Fastening Device for Blankets and the like on Printing Press Cylinders"; and U.S. Pat. No.: 4,006,686 to Ackerman, entitled "Blanket Fastening Means for a Cylinder Blanket".

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A transfer cylinder of a sheet fed printing press, the transfer cylinder having a length, with a groove disposed along at least a portion of the length of the cylinder, and a perimeter surface about an exterior of the cylinder, the groove having a first side surface and a second side surface, the second side surface being disposed opposite the first side surface, the transfer cylinder comprising:

a blanket for being stretched about the perimeter surface of the cylinder, the blanket having a first end and a second end; and apparatus for stretching the blanket about the perimeter surface of the cylinder, said stretching apparatus comprising:

a cylinder section disposed within the groove, said cylinder section being pivotably mounted within the groove to pivot away from the cylinder to an open position and towards the cylinder to a closed position, the cylinder section, in the closed position having a first surface comprising a portion of said perimeter surface and a second surface disposed towards said cylinder;

a leaf spring disposed within the groove adjacent the first side surface of the groove, the leaf spring having a first end fastened within the groove and a second end opposite to said first end, sad second end being movable within the groove in a direction parallel to the circumference of the cylinder;

first means for releasably retaining the first end of the blanket on said leaf spring within the groove;

said first means for releasably retaining the first end of the blanket on said leaf spring comprising;

a plurality of first projections disposed on the first end of the blanket, said plurality of first projections comprising button means having a first end with a recessed portion adjacent said first end, the first end having a first diameter and the recessed portion having a second diameter, the first diameter being greater than the second diameter; and a plurality of corresponding first recessed disposed through said second end of said leaf spring, said plurality of button means being configured to be disposed through and suspended within said first recesses, and said plurality of first recesses being configured for receiving and suspending said plurality of button means therein;

second means for releasably retaining the second end of the blanket on the cylinder section; and the cylinder section being configured for stretching the blanket about the cylinder upon the pivoting of the cylinder section from the open position to the closed position.

2. The cylinder according to claim 1, wherein said second end of said leaf spring is configured for being tensioned solely by the blanket upon the pivoting of the cylinder section from the open position to the closed position.

3. The cylinder according to claim 2, wherein:

said first end of the blanket comprises a bar disposed along the width of the blanket, said button means of said first end of the blanket being disposed on said bar,; and said first recesses of said leaf spring comprise a first portion having a diameter greater than the first diameter of the button means of said first blanket end, and a second portion having a diameter less than the first diameter of the button means of said first blanket end and greater than the second diameter of the recessed portion of the button means of said first blanket end to thereby suspend said button means of the first blanket end within said first recesses of said leaf spring when the recessed portion of the button means is disposed in the second portion of the first recesses of the leaf spring.

4. The cylinder according to claim 3, wherein:

said second means for releasably retaining the second end of the blanket on the cylinder section comprising:

a plurality of second projections disposed along the second surface of the cylinder section; and a plurality of corresponding second recesses disposed along the second end of the blanket, said plurality of second recesses of said second end of said blanket being configured for retaining said plurality of second projections of said second surface of the cylinder section therein.

5. The cylinder according to claim 4, wherein:

said button means comprise bolts on said first end of the blanket; and said second projections comprise bolts on the second surface of the cylinder section.

6. The cylinder according to claim 5, wherein:

the second end of the blanket comprises rod means disposed along the width of the blanket, the second recesses of said second end of said blanket being disposed adjacent the rod means; and the bolts of the cylinder section having a recessed portion for receipt of the rod means therein to retain the second end of the blanket on the cylinder section upon insertion of the bolts of the cylinder section through the second recesses of the second end of the blanket.

7. The cylinder according to claim 6, further including:

first resilient means for forcing the rod means of the second end of the blanket into engagement with the bolts of the cylinder section; and second resilient means for forcing the bolts of the first end of the blanket into engagement with the second portion of the first recesses of the leaf spring.

8. The cylinder according to claim 7, wherein:

said cylinder section comprises set screws for limiting movement of said cylinder section towards said cylinder to adjust the tensioning of the blanket around the cylinder; and said apparatus further includes locking means for locking said cylinder section into the closed position.

9. The cylinder according to claim 8, additionally comprising:

a liner sheet for being disposed between the blanket and the perimeter surface of the cylinder, said liner sheet for being stretched along with said blanket by said closing of said cylinder section; and gripping means for gripping sheets being transferred by the cylinder, said gripping means being disposed within the groove, between the leaf spring of the first side surface of the groove and the cylinder section, and the gripping means comprising a first surface disposed adjacent the cylinder section and a gripping arm movable towards and away from the first surface to retain the sheets therebetween during said transferring of the sheets.

10. The cylinder according to claim 9, wherein:

said locking means for locking said cylinder section into the closed position comprise locking screws, the locking screws being pivotable towards and away from the cylinder section to engage and disengage the cylinder section;

said first end of said blanket comprises grasping means for pulling said bolts of said first blanket end against said second resilient means to disengage said bolts of said first blanket end from said first recesses of said leaf spring;

said rod means of said second blanket end comprises a first spring rod, said first spring rod having a convex surface;

said recessed portions of said bolts of said cylinder section having a concave surface, said concave surface of said recessed portion matching said convex surface of said first spring rod; and said second resilient means comprises a second spring rod, said second spring rod being disposed on said leaf spring.

11. A method for stretching a cylinder blanket about a sheet transfer cylinder of a printing press, the blanket having a first end and a second end; the cylinder having a length, with a groove disposed along at least a portion of the length of the cylinder, and a perimeter surface about an exterior of the cylinder, the groove having a first side surface and a second side surface, the second side surface being disposed opposite the first side surface, the cylinder comprising;

a cylinder section for being disposed within the groove, said cylinder section for being pivotably mounted within the groove to pivot away from the cylinder to an open position and towards the cylinder to a closed position, the cylinder section, in the closed position having a first surface comprising a portion of said perimeter surface and a second surface disposed towards said cylinder;

a leaf spring disposed within the groove adjacent the first side surface of the groove, the leaf spring having a first end fastened within the groove and a second end opposite to said first end, said second end being movable within the groove in a direction parallel to the circumference of the cylinder;

first means for releasably retaining the first end of the blanket on said leaf spring within the groove;

said first means for releasably retaining the first end of the blanket on said leaf spring comprising:

a plurality of first projections disposed on the first end of the blanket, said plurality of projections comprising button means having a first end with a recessed portion disposed adjacent said first end, said first end having a first diameter and said second end having a second diameter with said first diameter being greater than said second diameter; and a plurality of corresponding first recesses disposed through said second end of said leaf spring, said plurality of button means being configured to be disposed through and suspended within said first recesses, and said plurality of first recesses being configured for receiving and suspending said plurality of button means therein;

second means for releasably retaining the second end of the blanket on the cylinder section; and the cylinder section being configured for stretching the blanket about the cylinder upon the pivoting of the cylinder section from the open position to the closed position;

said method comprising the steps of:

fastening the first end of the blanket to the leaf spring by inserting said button means on the first blanket end through said first recesses of said leaf spring to fasten the first blanket end to the first side surface of the groove;

wrapping the cylinder blanket around the perimeter surface of the cylinder;

pivoting the cylinder section to the open position;

fastening the second end of the blanket to the cylinder section with said second means for releasably retaining the second end of the blanket on the cylinder section; and stretching the blanket around the cylinder by pivoting the cylinder section to the closed position;

12. The method according to claim 11, wherein said first recesses of said leaf spring comprise a first portion having a diameter greater than the first diameter of the button means of sad first blanket end, and a second portion having a diameter less than the first diameter of the button means of said first blanket end and greater than the second diameter of the recessed portion of the button means of said first blanket end to thereby suspend said button means of the first blanket end within said first recesses of said leaf spring when the recessed portion of the button means is disposed in the second portion of the first recesses of the leaf spring; and said method further comprises the steps of:

inserting the first end of the button means of the first blanket end through the first portion of the first recesses of the leaf spring; and engaging said recessed portion of the button means of the first blanket end with the second portion of the first recesses of the leaf spring to suspend said bolts of said first blanket end in said first recesses of said leaf spring.

13. The method according to claim 12, wherein:

said means for releasably retaining the second end of the blanket on the cylinder section comprises:

a plurality of second projections disposed along the second surface of the cylinder section; and a plurality of corresponding second recesses disposed along the second end of the blanket, said plurality of second recesses of said second end of said blanket being configured for retaining said plurality of second projection of said second surface of the cylinder section therein; and said method further comprises the step of:

disposing said second projections of said cylinder section through said second recesses of said second blanket end to fasten said second blanket end to the cylinder section.

14. The method according to claim 13, wherein said button means comprise bolts on said first end of the blanket, said second projections comprise bolts on the second surface of the cylinder section, and said method further comprises the steps of:

inserting the bolts on the first blanket end into said first recesses of said second end of said leaf spring to fasten the first blanket end to said leaf spring; and disposing said bolts of said cylinder section through said second recesses of said second blanket end to fasten said second blanket end to the cylinder section.

15. The method according to claim 14, wherein said first end of the blanket comprises a bar disposed along the width of the blanket, said bolts of said first end of the blanket being disposed on said bar, the second end of the blanket comprises rod means disposed along the width of the blanket, the second recesses of said second end of said blanket being disposed adjacent the rod means, and the bolts of the cylinder section having a recessed portion for receipt of the rod means therein to retain the second end of the blanket on the cylinder section upon insertion of the bolts of the cylinder section through the second recesses of the second end of the blanket; and said method further comprises the steps of:

disposing the bolts of the cylinder section through the second recesses of the second blanket end to engage the rod means of the second blanket end with the recessed portion of the bolts of the cylinder section to retain said second blanket end on said bolts of said cylinder section.

16. The method according to claim 15, wherein ad cylinder section comprises set screws for limiting movement of said cylinder section towards said cylinder to adjust the tensioning of the blanket around the cylinder, and the cylinder further comprises locking means for locking the cylinder section in the closed position; and said method further comprises the steps of:

adjusting the tension on the stretched blanket by adjusting the set screws; and locking the cylinder section in the closed position with said locking means.

17. Apparatus for retaining and stretching a cylinder blanket on a cylinder of a sheet fed printing press, the cylinder having a length with a groove disposed along at least a portion of the length of the cylinder, the blanket for being stretched about a perimeter surface of the cylinder from a first side surface of the groove of the cylinder to a second side surface of the groove of the cylinder, said apparatus comprising:

a cylinder blanket, said cylinder blanket having a first end and a second end, the second end being opposite to the first end;

means for stretching the blanket about the cylinder, said means for stretching for being disposed in the groove of the cylinder;

first means for releasably retaining the first end of the blanket on said means for stretching;

second means for releasably retaining the second end of the blanket on the first side surface of the groove, said second means for releasably retaining the second end of the blanket on the first side surface of the groove comprising:

a plurality of first projections disposed along the second end of the blanket, and a plurality of corresponding first recessed disposed along the first side surface of the groove, the plurality of first recesses being configured for receiving and retaining the plurality of first projections therein;

the first projections having a first end for being disposed into the first recesses, and a recessed portion disposed adjacent said first end, said first end having a first diameter and said recessed portion having a second diameter, said first diameter being greater than said second diameter; and said first recesses comprise a first portion having a diameter greater than the first diameter of the first projections of the second blanket end, and a second portion having a diameter less than the first diameter of the first projections and greater than the second diameter of the recessed portion of the first projections to thereby suspend said first projections of the second blanket end within said first recesses when the recessed portion of the first projections is disposed in the second portion of the first recesses.

18. The apparatus according to claim 17, wherein:

said means for stretching comprises a pivoting body for being pivotably disposed within the groove of the cylinder to pivot away from the cylinder to an open position and towards the cylinder to a closed position; and said pivoting body is configured for stretching the blanket about the cylinder upon the pivoting of the pivoting body from the open position to the closed position.

19. The apparatus according to claim 18, wherein:

said pivoting body comprises a first surface for forming a part of the perimeter surface of the cylinder, and a second surface for being disposed towards the cylinder; and said first means for releasably retaining the first end of the blanket on the stretching means comprises a plurality of second projections disposed along the second surface of the pivoting body through a plurality of corresponding second recessed disposed along the first end of the blanket, the plurality of second recesses of the first end of the blanket being configured for retaining the plurality of second projections of said second surface of the pivoting section therein.

* * * * *

UNITED STATES PATENT AND TRADEMARK OFFICE

CERTIFICATE OF CORRECTION

PATENT NO. : 5,272,978

DATED : December 28, 1993

INVENTOR(S) : Josef WEHLE, et al.

It is certified that error appears in the above-indentified patent and that said Letters Patent is hereby corrected as shown below:

In Column 9, line 6, Claim 12, after 'of' delete "sad" and insert --said--.

In Column 10, line 5, Claim 16, after 'wherein' delete "ad" and insert --said--.

In Column 12, line 3, Claim 19, after 'second' delete "recessed" and insert --recesses--.

Signed and Sealed this

Twenty-first Day of November, 1995

*Attest:*

Bruce Lehman

BRUCE LEHMAN

*Attesting Officer*

*Commissioner of Patents and Trademarks*